US009901940B2

(12) United States Patent
Gong et al.

(10) Patent No.: US 9,901,940 B2
(45) Date of Patent: Feb. 27, 2018

(54) OUTLET DEVICE WITH HOLLOW WATER CURTAIN FUNCTION

(71) Applicants: XIAMEN SOLEX HIGH-TECH INDUSTRIES CO., LTD., Haicang Xiamen, Fujian (CN); Huasong Zhou, Haicang Xiamen, Fujian (CN)

(72) Inventors: Hailang Gong, Haicang Xiamen (CN); Tao Cai, Haichang Xiamen (CN); Shigang Wang, Haicang Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 158 days.

(21) Appl. No.: 15/012,928

(22) Filed: Feb. 2, 2016

(65) Prior Publication Data

US 2016/0221007 A1 Aug. 4, 2016

(30) Foreign Application Priority Data

Feb. 3, 2015 (CN) ..... 2015 1 0054975

(51) Int. Cl.

| | |
|---|---|
| ***B05B 1/26*** | (2006.01) |
| ***B05B 1/18*** | (2006.01) |
| ***B05B 1/16*** | (2006.01) |
| ***B05B 3/00*** | (2006.01) |
| ***B05B 3/04*** | (2006.01) |

(52) U.S. Cl.

CPC ..... *B05B 1/267* (2013.01); *B05B 1/1636* (2013.01); *B05B 1/185* (2013.01); *B05B 3/008* (2013.01); *B05B 3/04* (2013.01); *B05B 3/0422* (2013.01)

(58) Field of Classification Search

CPC ..... B05B 1/267; B05B 1/1636; B05B 1/185; B05B 3/008; B05B 3/04; B05B 3/0422

USPC ..... 239/463, 468, 469, 470, 485, 518, 520

See application file for complete search history.

(56) References Cited

U.S. PATENT DOCUMENTS 3,034,728 A * 5/1962 Hruby, Jr. ..... B05B 3/00 239/463

2004/0227016 A1* 11/2004 Yagi ..... B05B 1/265 239/518

* cited by examiner

*Primary Examiner* — Steven J Ganey

(74) *Attorney, Agent, or Firm* — Rabin & Berdo, P.C.

(57) ABSTRACT

An outlet device with hollow water curtain function includes a hollow housing and a deflecting column inserted in the housing. An annular passage is formed between the housing and the deflecting column. The housing further includes a plurality of arc-shaped inlet slots. The arc inlet slots are annularly arranged about the center of the annular passage. The internal port of the arc inlet slots is connected to the annular passage. Water flows to the annular passage through the arc inlet slots to from a hollow annular water curtain with centrifugal force. When the tangential centrifugal force of the water curtain orienting the opening angle of the housing is larger than the surface tension thereof, the water curtain breaks open to make the water flowing break open and diffuse as particles after keeping itself in a certain length. The diffused water forms a water type continuous in a certain range.

11 Claims, 8 Drawing Sheets

OUTLET DEVICE WITH HOLLOW WATER CURTAIN FUNCTION

TECHNICAL FIELD

The present invention relates to an outlet device, especially to an outlet device with hollow water curtain function applied in a shower head.

BACKGROUND

People design different outlet devices with shower water, column water, bubble water or massage water to obtain different shower effect, there is a kind of outlet device that can have hollow water curtain function in the recent market. The existing outlet device with hollow water curtain function is applied with a simple trumpet structure to deflect the water, although it can achieve a hollow water curtain, the shower area of the water curtain is small, and it has bad water flowing feeling, it is just another shape of column water that doesn't change the shower quality.

SUMMARY

The present invention is provided with an outlet device with hollow water curtain function, which overcomes the disadvantages of the existing known technology. The technical proposal of the present invention is that:

An outlet device with hollow water curtain function, comprising a hollow housing and a deflecting column inserted in the housing, an annular passage is formed between the housing and the deflecting column, wherein the housing further comprises a plurality of arc-shaped inlet slots, the arc inlet slots are annularly arranged about the center of the annular passage, the internal port of the arc inlet slots is connected to the annular passage, water flows to the annular passage through the arc inlet slots to from a hollow annular water curtain with centrifugal force.

In another preferred embodiment, the arc inlet slot is arranged vertical to the inlet direction.

In another preferred embodiment, the arc inlet slots are disposed on the internal periphery surface of the housing, the arc inlet slots are spiral shape and extending downwardly.

In another preferred embodiment, the top end of the deflecting column is disposed with a cone frustum with small end down, the deflecting column is placed in the center of the cone frustum; the housing is disposed with a positioning groove having the shape coupled to the cone frustum, the arc inlet slots are disposed on the bottom surface of the positioning groove.

In another preferred embodiment, the top surface of the cone frustum is disposed with an annular water groove and an elastic ring disposed in the water groove, the bottom surface of the water groove is disposed with through holes connected to the arc inlet slots.

In another preferred embodiment, the annular passage comprises an upper flowing section and a lower flowing section, the lower flowing section is trumpet shaped with big end down, In another preferred embodiment, the bottom surface of the deflecting column is located at the connecting position of the upper flowing section and the lower flowing section.

In another preferred embodiment, the upper flowing section is trumpet shaped with big end down, the taper of the upper flowing section is smaller than that of the lower flowing section.

In another preferred embodiment, the ratio of the length of the upper flowing section to the lower flowing section is equal or larger than 3.

In another preferred embodiment, the deflecting column is disposed with a hollow passage, the hollow passage has a spherical arc surface structure near to the outlet, the outlet of the hollow passage is slender shaped or a structure with two slender openings crossing.

Compared to the existing known technology, the technical proposal of the present invention has advantages as follow:

1. the housing is disposed with a plurality of arc inlet slots, the internal port of which is connected to the annular passage, water flows to the arc inlet slots vertically via the through holes, rotates along the arc inlet slots to flow to the annular passage and then flows out being a hollow annular water curtain with centrifugal force, when the tangential centrifugal force of the water curtain orienting the opening angle of the housing is larger than the surface tension thereof, the water curtain breaks open to make the water flowing break open and diffuse as particles after keeping itself in a certain length, the diffused water forms a water type continuous in a certain range, the shower area is large, and the water particle feels good.

2. The arc inlet slots are vertical to the inlet direction, on one hand, it changes the flowing direction that makes the water with centrifugal force after flowing out of the arc inlet slots, on the other hand, as the deflecting column must have a certain length, it can maximally prevent the limit to the structure thickness.

3. The arc inlet slots are spiral, and they are arranged on the internal periphery surface of the annular passage, the structure not only makes the water with centrifugal force, but also makes it with speeding up function.

4. the deflecting column is disposed at the center of the cone frustum; the housing is disposed with positioning groove coupled to the cone frustum, it ensures the coaxiality of the deflecting column and the annular passage to improve the outlet effect of the water curtain, on the other hand, more strong the water pressure is, more tightly the cone frustum is connected to the housing, it thus improves the coaxiality of both.

5. The bottom surface of the water groove is disposed with through holes connected to the arc inlet slots, the elastic ring is disposed in the water groove, the elastic ring automatically deforms with the water pressure, so that the flow volume can be controlled to be stable, it can prevent water pressure from influencing the water type, thus improving the stability of the water curtain.

6. The upper flowing section is trumpet shape with big end down, it thus improves the length of the water curtain and enlargers the shower area, the lower flowing section is trumpet shape with big end down, as the water flowing has certain centrifugal force, the lower flowing section can limit in a certain flare angle that can make it with better shower area and shower effect.

7. The deflecting column is disposed with a hollow passage, the hollow passage has a spherical arc surface structure near to the outlet, the outlet of the hollow passage is slender shaped or a structure with two slender openings crossing, the structure is coupled to the hollow passage at the internal ring and the annular passage at the external ring to make the outlet even and consistent.

BRIEF DESCRIPTION OF THE DRAWINGS

The present invention will be further described with the drawings and the embodiments.

DETAILED DESCRIPTION OF THE EMBODIMENTS

Figure 1:
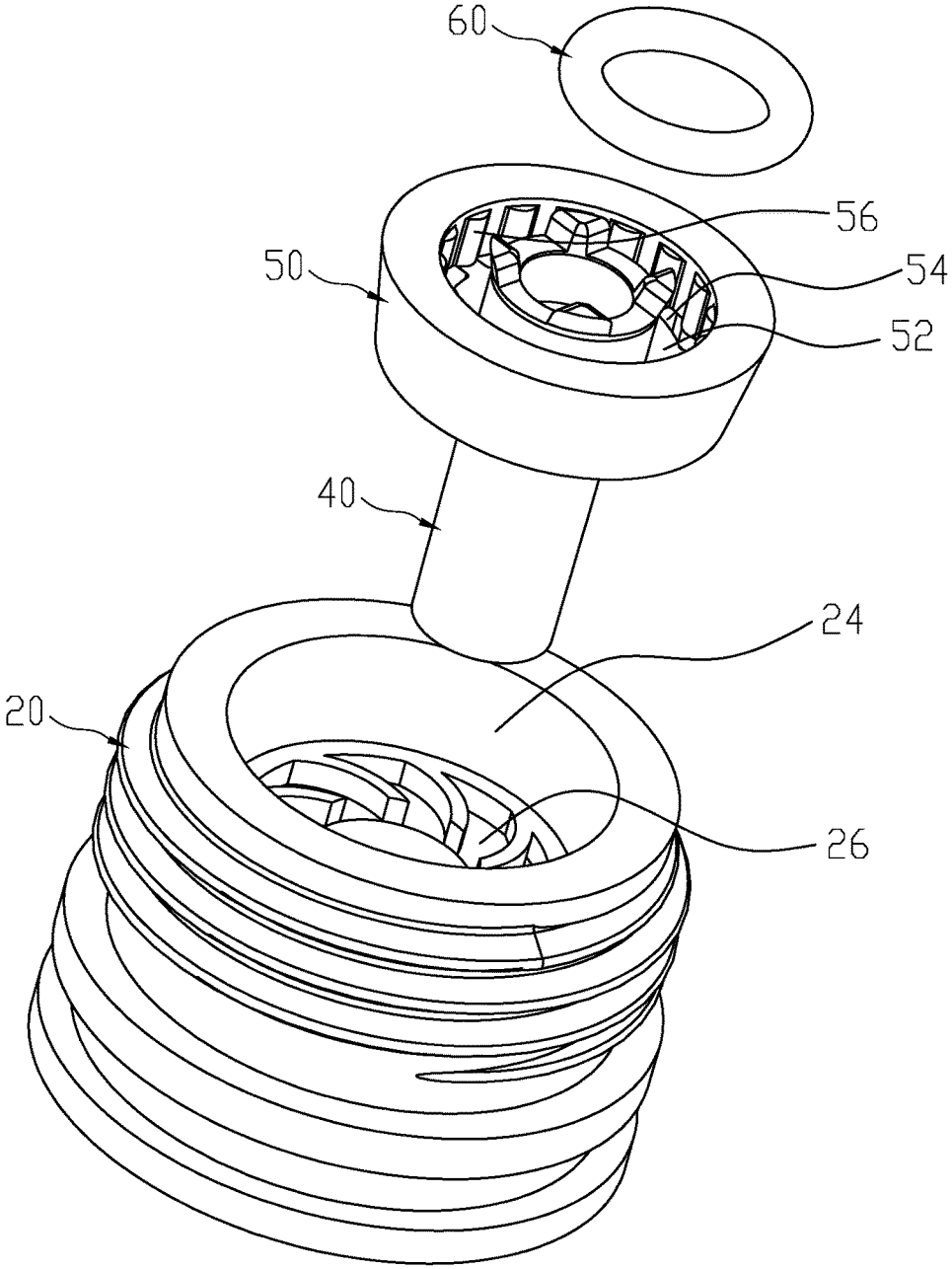
FIG. 1 illustrates an exploded and schematic diagram of the outlet device of the present invention.
Figure 2:
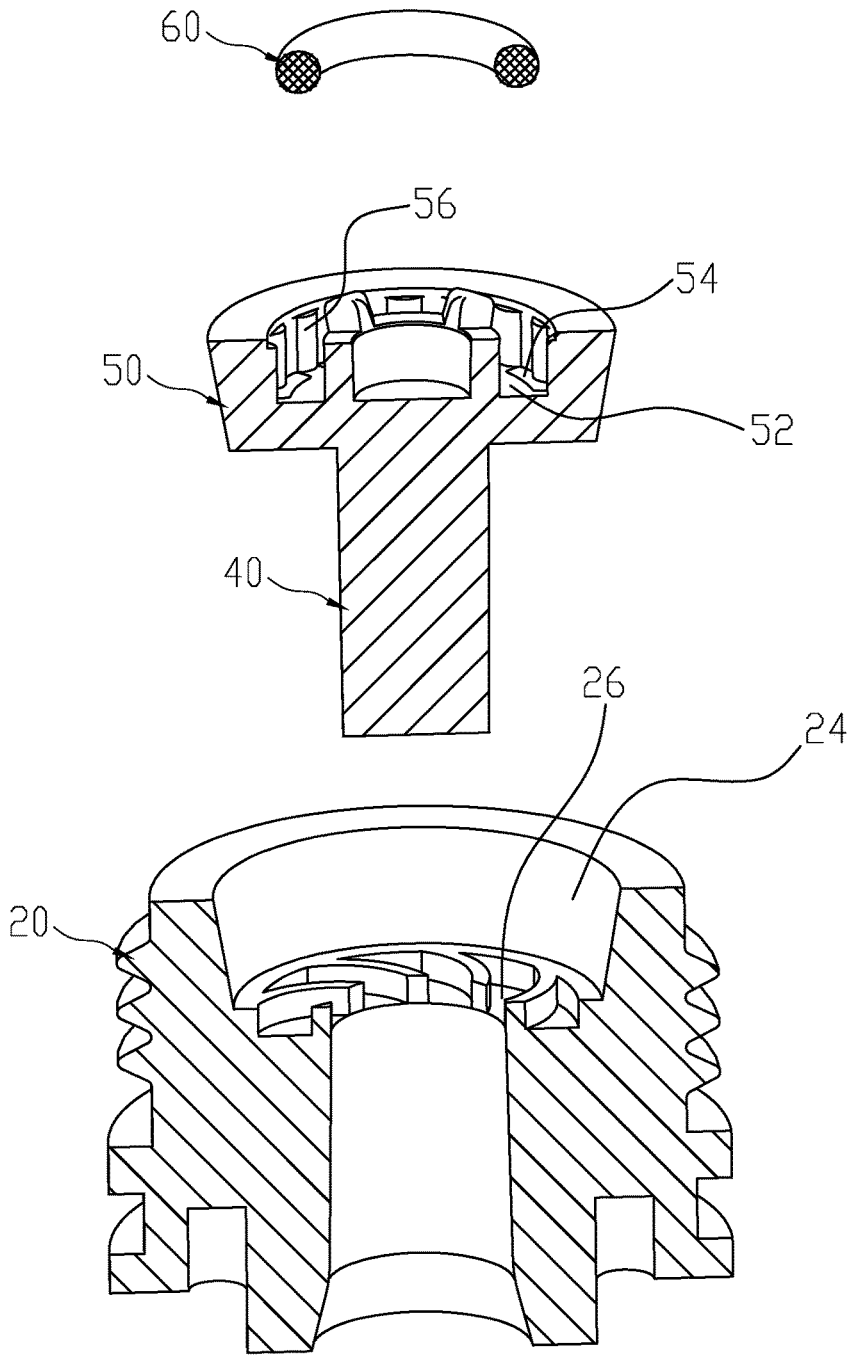
FIG. 2 illustrates an exploded schematic and sectional diagram of the outlet device of FIG. 1.

Referring to FIG. 1 and FIG. 2, the outlet device with hollow water curtain function of the present invention comprises a housing 20, a deflecting column 40 and an elastic ring 60. The housing 20 is hollow structural.

Figure 3:
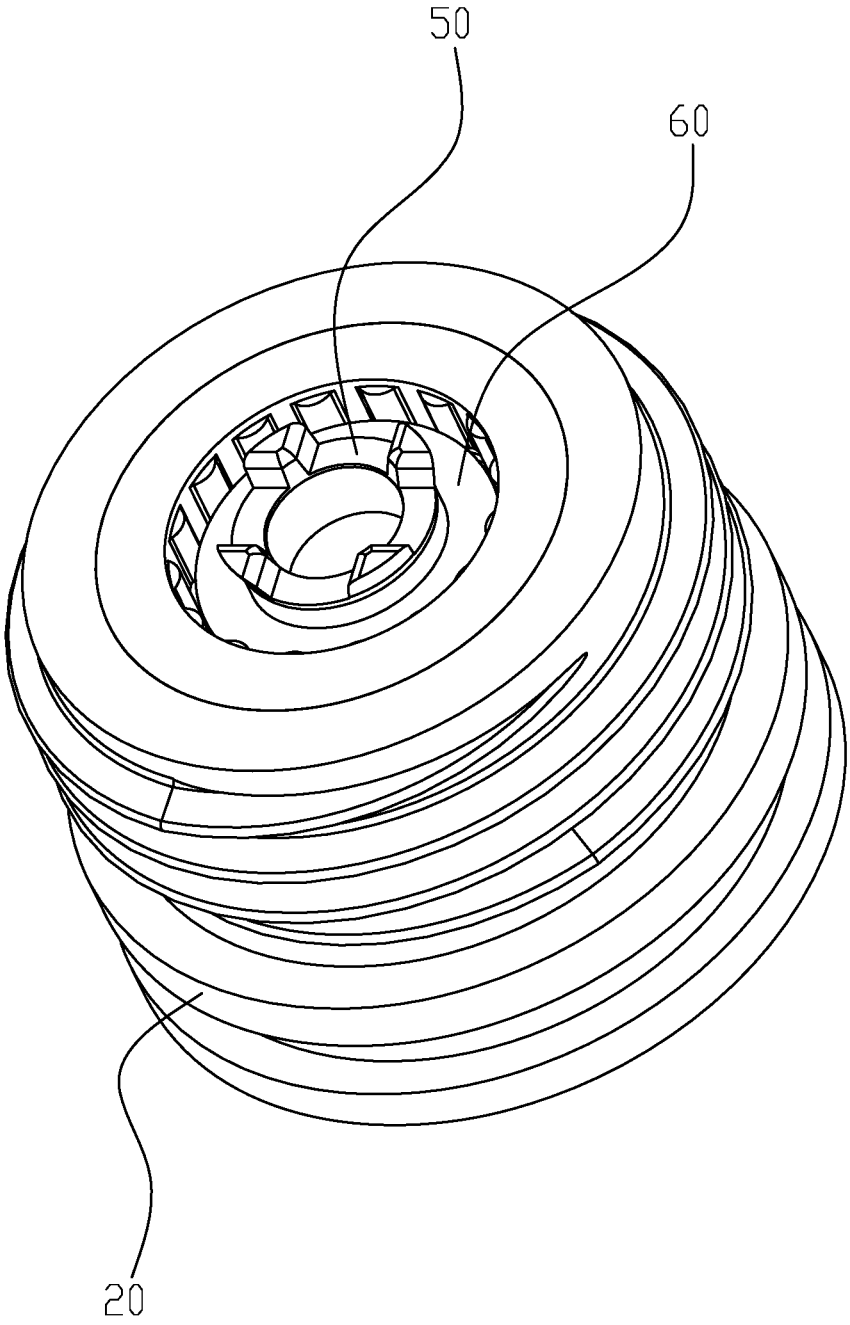
FIG. 3 illustrates a schematic assembling diagram of the outlet device of FIG. 1.
Figure 4:
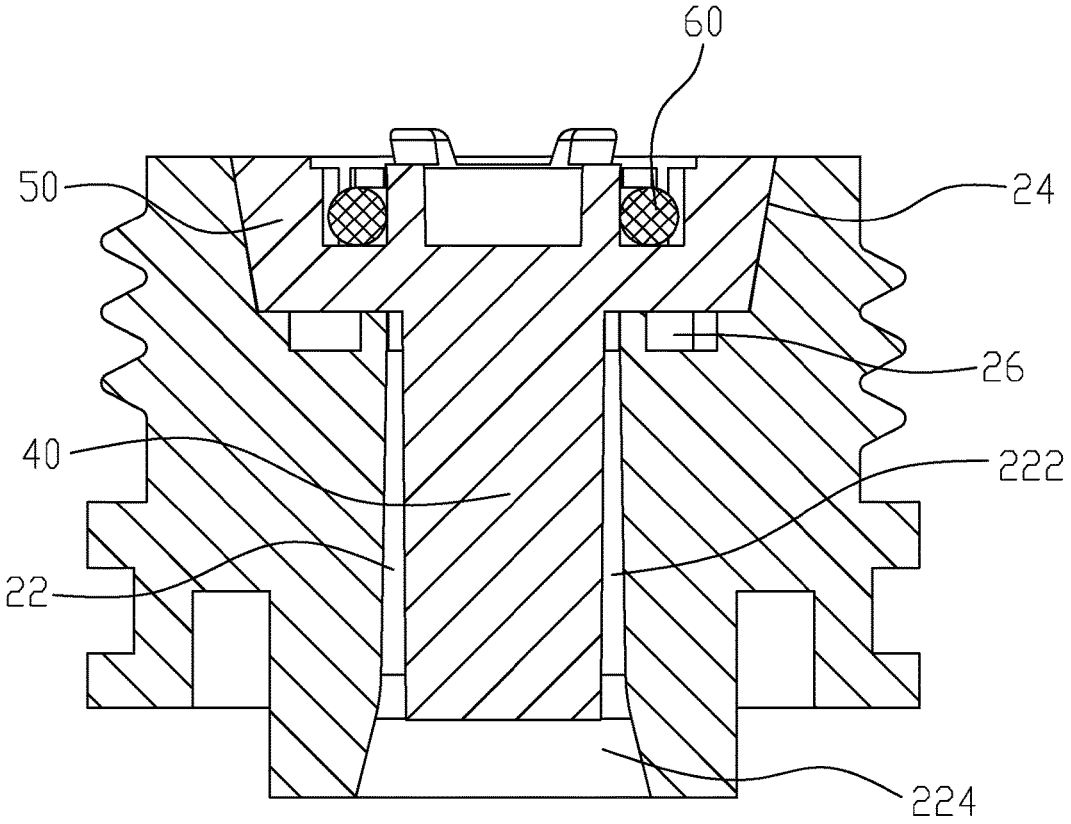
FIG. 4 illustrates a sectional diagram of the outlet device of FIG. 1.

Referring to FIG. 3 and FIG. 4, the deflecting column is inserted in the housing 20, an annular passage 22 is formed between the housing 20 and the deflecting column 40, the annular passage 22 comprises an upper flowing section 222 and a lower flowing section 224, the upper and lower flowing section are trumpet shape with big end down (a necking structure with big end down), and the upper flowing section 222 is much longer than the lower flowing section 224, the taper of the upper flowing section 222 is smaller than that of the lower flowing section 224. Preferred, the ratio of the length of the upper flowing section to the lower flowing section is equal to or lager than 3. The bottom surface of the deflecting column 40 is located at the connecting position of the upper flowing section 222 and the lower flowing section 224. The top surface of housing 20 is disposed with a positioning groove 24, which is trumpet structural with small end down, the positioning groove 24 is coaxially connected to the annular groove 22. The housing 20 is disposed with a plurality of arc-shaped inlet slots 26, the arc inlet slots 26 are spiral shape, the arc inlet slots 26 are annularly arranged about the center of the annular passage 22, the internal port of the arc inlet slots 26 is connected to the annular passage 22.

The deflecting column 40 is column shaped. The top end of the deflecting column 40 is disposed with a cone frustum 50 with small end down, the deflecting column 40 is disposed at the center of the cone frustum 50. The top surface of the cone frustum 50 is disposed with annular water groove 52, the bottom surface of the annular water groove 52 is disposed with through holes 54 connected to the arc inlet slots 26, water flows vertically into the arc inlet slots 26 via the through holes 54, that is to say, the arc inlet slots 26 are arranged vertically to the inlet direction. The elastic ring 60 is disposed in the annular water groove 52. The side wall of the annular water groove 52 is disposed with a protruding block 56, which can prevent the elastic ring from fully closing the through hole in high water pressure situation.

Figure 5:
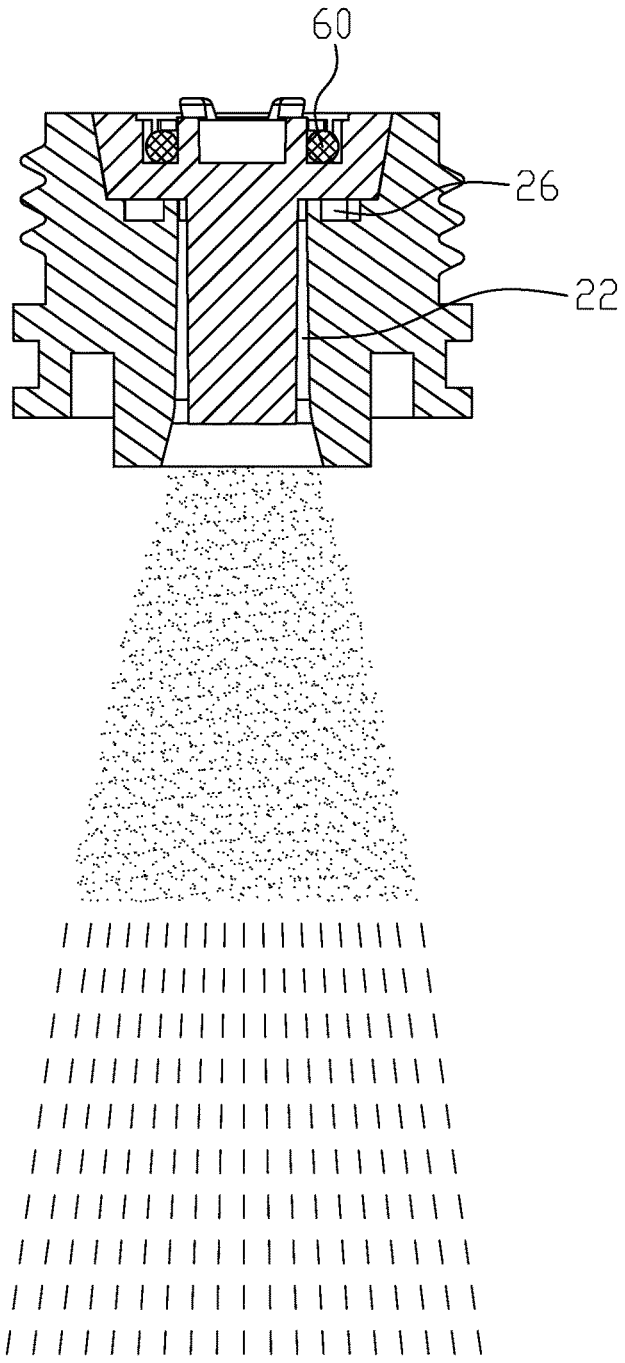
FIG. 5 illustrates a sectional diagram of the outlet device of FIG. 1 in low water pressure.

Referring to FIG. 5, when water pressure of the waterway is lower than 0.3 MPA, the elastic ring 60 deforms slightly, water flows to the arc inlet slots 26 vertically via the through holes 54, rotates along the arc inlet slots 26 to flow to the annular passage 22 and then flows out being a hollow annular water curtain with centrifugal force. When the tangential centrifugal force of the water curtain orienting the opening angle of the housing 20 is larger than the surface tension thereof, the water curtain breaks open to make the water flowing break open and diffuse as particles after keeping itself in a certain length, forming a hollow rain to obtain the shower need in a larger shower area with particle feeling.

Figure 6:
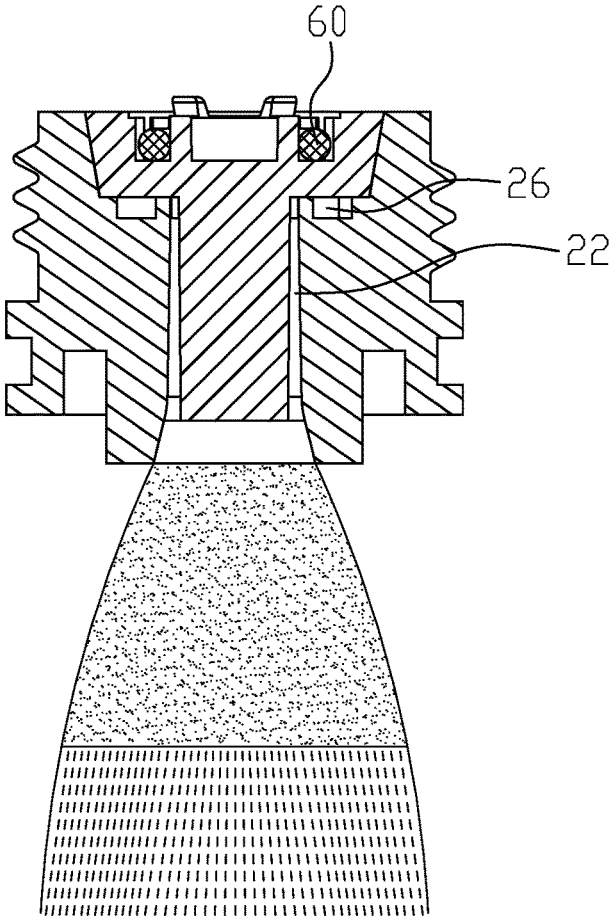
FIG. 6 illustrates a sectional diagram of the outlet device of FIG. 1 in high water pressure.

Referring to FIG. 6, when the water pressure of the water way is larger than 0.3 MPA, the elastic ring 60 deforms great, the flow volume in the arc inlet slots 26 is kept stable, the water type is not influenced to change by the water pressure, the water curtain and the hollow rain are kept well.

It can be understood that the arc inlet slots 26 can be disposed on the internal periphery surface of the housing 20, the arc inlet slots 26 are spiral shape and extending downwardly, therefore, it can improve the flow rate.

Figure 7:
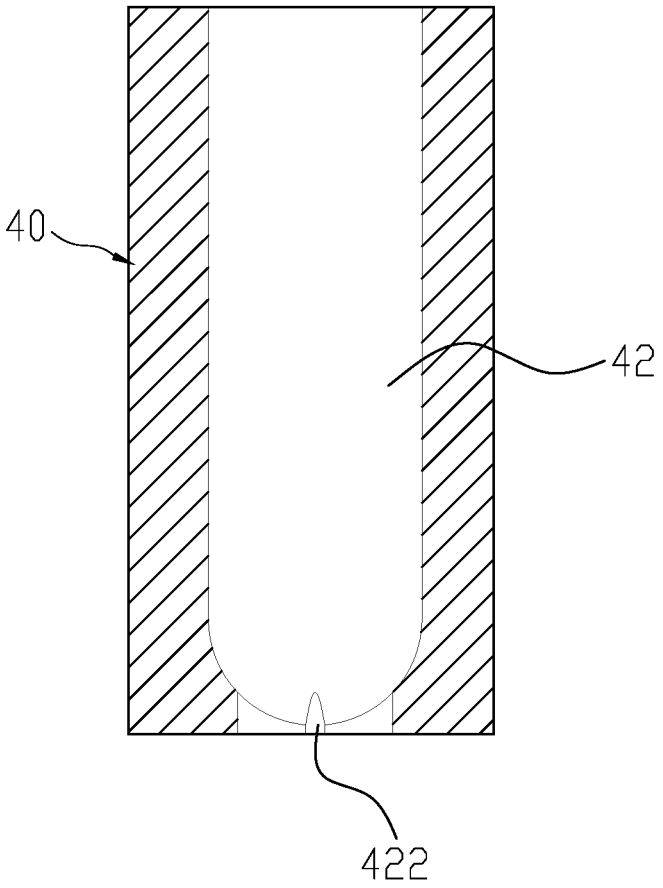
FIG. 7 illustrates a sectional diagram of a second kind of deflecting column of the outlet device of the present invention.
Figure 8:
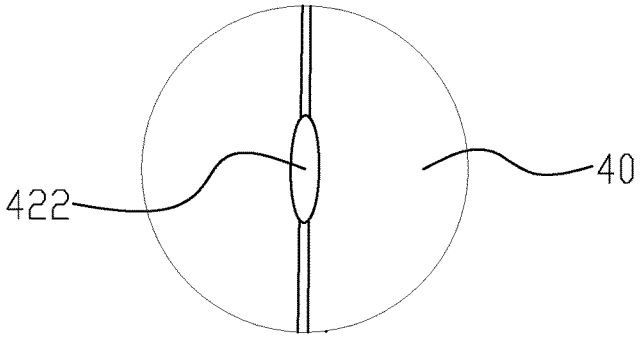
FIG. 8 illustrates a bottom view of the deflecting column of FIG. 7.
Figure 9:
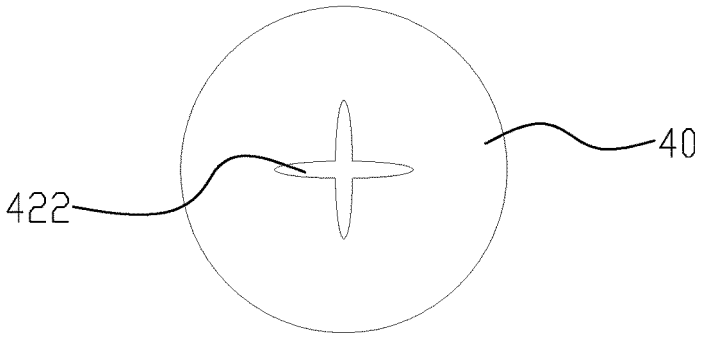
FIG. 9 illustrates a schematic diagram of a third kind of deflecting column of the outlet device of the present invention.

Referring to FIG. 7, to improve the water curtain and make it more even, the deflecting column 40 is disposed with a hollow passage 42, the hollow passage 42 has a spherical arc surface structure near to the outlet, the outlet 422 of the hollow passage 42 is slender shaped (as figured in FIG. 8) or a structure with two slender openings crossing (as figured in FIG. 9).

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An outlet device with hollow water curtain function, comprising:

a hollow housing including a central passage through the housing from a first end to a second end of the housing, a groove at the first end of the housing having a diameter larger than a diameter of the central passage, an inlet to the central passage formed in a center of the groove, and a plurality of arc-shaped inlet slots formed in a base of the groove surrounding the inlet to the central passage; and a deflecting column inserted in the central passage of the housing to form an annular passage between the deflecting column and the housing, the deflecting column having a first end and a second end, the first end positioned adjacent to the plurality of arc-shaped inlet slots and the second end located in the central passage to form the annular passage, wherein the arc-shaped inlet slots are connected to the annular passage, such that when water is provided to the arc-shaped inlet slots, the water flows through the arc-shaped inlet slots to the annular passage to form a hollow annular water curtain with centrifugal force.

2. The outlet device with hollow water curtain function according to claim 1, wherein the arc-shaped inlet slots extend in a depth direction into the housing in the base of the groove of the housing.

3. The outlet device with hollow water curtain function according to claim 1, wherein the arc-shaped inlet slots are disposed on the internal periphery surface of the housing, and the arc-shaped inlet slots are spiral shaped and extending downwardly in a direction from the first end to the second end of the housing.

4. The outlet device with hollow water curtain function according to claim 1, wherein the first end of the deflecting column has a cone frustum shape, a small end of the cone frustum facing the base of the groove of the housing, and a cylindrical portion of the deflecting column in the central passage of the housing has a cylindrical shape, the cylindrical portion of the deflecting column connected to the center of the cone frustum, and the groove of the housing has a shape that conforms to a shape of the cone frustum.

5. The outlet device with hollow water curtain function according to claim 4, wherein a top surface of the cone frustum opposite the small end of the cone frustum has a diameter larger than the small end of the cone frustum and includes an annular water groove, a bottom surface of the water groove including through holes connected to the arc-shaped inlet slots.

6. The outlet device with hollow water curtain function according to claim 5, further comprising an elastic ring disposed in the water groove.

7. The outlet device with hollow water curtain function according to any one of claims 1-5, wherein the annular passage comprises an upper flowing section at a first end of the annular passage adjacent to the groove of the housing and a lower flowing section adjacent to the second end of the housing, and the lower flowing section is trumpet shaped, such that a first end of the lower flowing section is adjacent to the upper flowing section and a second end of the lower flowing section defines an outlet from the housing at the second end of the housing, the second end of the lower flowing section having a diameter larger than the first end of the lower flowing section.

8. The outlet device with hollow water curtain function according to claim 7, wherein the second end of the deflecting column is located at a connecting position where the upper flowing section connects to the lower flowing section.

9. The outlet device with hollow water curtain function according to claim 7, wherein the upper flowing section is trumpet shaped, such that a first end of the upper flowing section is adjacent to the groove and a second end of the lower flowing section is adjacent to the lower flowing section, the second end of the upper flowing section having a diameter larger than the first end of the upper flowing section, a taper of the upper flowing section being smaller than that of the lower flowing section.

10. The outlet device with hollow water curtain function according to claim 7, wherein a ratio of a length of the upper flowing section to the lower flowing section is equal or larger than 3.

11. The outlet device with hollow water curtain function according to any one of claims 1-5, wherein the deflecting column includes a hollow passage including an inlet at the first end of the deflecting column and an outlet at the second end of the deflecting column, the hollow passage has a spherical arc surface structure near to the outlet of the hollow passage, and the outlet of the hollow passage is slender shaped or a structure with two slender openings crossing.

* * * * *